United States Patent [19]

Hauesler et al.

[11] Patent Number: 4,574,606

[45] Date of Patent: Mar. 11, 1986

[54] ADJUSTING THE ROLLS IN A ROLLING MILL WITH OBLIQUELY ORIENTED, CONICALLY CONTOURED ROLLS

[75] Inventors: Karl H. Hauesler, Korschenbroich; Heinrich Steinbrecher, Meerbusch; Walter vom Dorp, Moenchengladbach, all of Fed. Rep. of Germany

[73] Assignee: Mannesmann AG, Duesseldorf, Fed. Rep. of Germany

[21] Appl. No.: 703,607

[22] Filed: Feb. 20, 1985

[30] Foreign Application Priority Data

Feb. 23, 1984 [DE] Fed. Rep. of Germany ..... 3406841

[51] Int. Cl.[4] ..... B21B 13/00

[52] U.S. Cl. ..... 72/100

[58] Field of Search ..... 72/78, 95, 100

[56] References Cited

U.S. PATENT DOCUMENTS 2,101,357 12/1937 Assel ..... 72/100
4,395,895 8/1983 Bretschneider et al. ..... 72/78

FOREIGN PATENT DOCUMENTS 205790 12/1967 U.S.S.R. ..... 72/100
493284 11/1975 U.S.S.R. ..... 72/100

*Primary Examiner*—Lowell A. Larson
*Attorney, Agent, or Firm*—Ralf H. Siegemund

[57] ABSTRACT

The adjustment provides for three degrees of freedom, in which in addition to varying the distance of the rolls from the rolling axis an adjustment axis is provided generally parallel to the rolling axis and about which the roll mount can be tilted. This adjustment axis itself may also be tilted for changing the speeding of the rolls.

2 Claims, 10 Drawing Figures

ADJUSTING THE ROLLS IN A ROLLING MILL WITH OBLIQUELY ORIENTED, CONICALLY CONTOURED ROLLS

BACKGROUND OF THE INVENTION

The present invention relates to the positioning and adjusting of rolles within an oblique roll rolling mill, particularly of the type using three rolls with generally conical rolling surfaces having axes which are oriented relative to the axes of the rolled stock at a rather large angle and appearing as a spreading angle or angle of spread which opens in the direction of rolling.

The so called high reduction oblique roll rolling mills are known also in a variety called planetary type oblique rolling mills with a rotating rolling frame and a non-rotating tube. Alternatively oblique constructed as a three roll rolling mill with conical rolling surfaces and inclined axes, for a high degree of reduction of tubes and having a stationary rolling stand and rotating tubular hollow. In all cases one has to consider the smooth bore requirement for the hollow to be made. This follows from the fact, that any of these high reduction rolling mills, for purposes of manufacturing particular wall thickness tolerances constitute already a final stage, i.e. no further deforming with an interior tool or the like is necessary (or should be). Therefore any surface undulation or waviness which is typical for oblique rolling processes generally and is manifested as local wall thickness variation of helical configuration cannot be tolerated, particularly if the wall thickness is rather thin to begin with.

The same requirement for obtaining a smooth bore is also posed in the so called Assel rolling mills, but with the difference that stretching and feed advance are very small, so that the spacial orientation of the rolling axes exhibits only a very small angle relative to the axes of the rolles stock. This means that the smooth bore effect in the case of a dimension depending roll adjustment is controllable only to a very minimal extent.

The situation is quite different for socalled high reduction oblique rolling mills, wherein a hollow billit is stretched through utilization of a cylindrical mandrel rod for purposes of obtaining a hollow tube. Very large stretch values are feasible resulting for these kinds of rolling mills from the rather favorable operational conditions referring to the speed, which in turn are the consequence of the particular spacial disposition of the rolls. It is thus of no consequence that in the case of a planetary, oblique axes rolling mills, the rolls in fact revolve about the tube in a planetary type movement, while in the case of a three roll mill with conical rolls the tube rotates.

Therefore in the following only the rotating stock will be described, and only one of the three rolls are considered; any extension of the concept particularly with regard to the relative aspects of rotation follow logically from these considerations.

DETAILED DESCRIPTION (PRELIMINARY)

Figure 1:
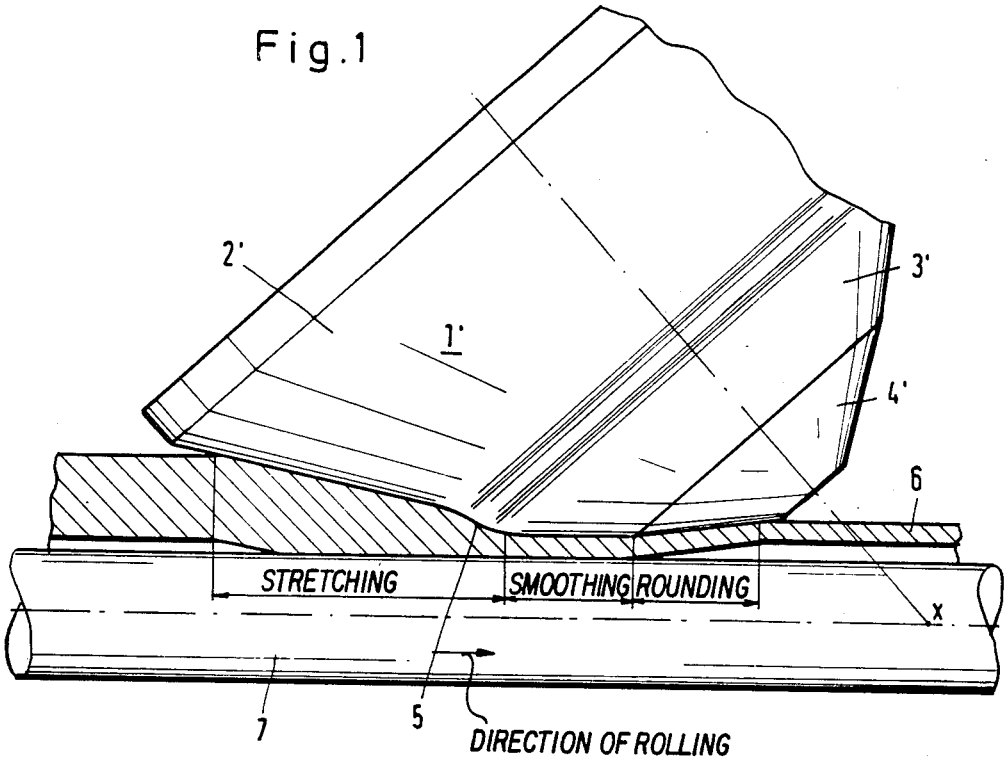
FIG. 1 illustrates the rolling gap of a three roll rolling mill with conical and obliquely oriented rolls.

Proceeding now to the detailed description of the drawings, reference is made to FIG. 1, which illustrates rolling and sizing which, as is customary, for oblique rolling mills, can be divided into three zones, the stretch zone, the smoothing zone and the rounding zone. The FIG. shows particularly the rolling gap for a three roll rolling stand with obliquely oriented rolls each having basically a conical configuration. One of the rolls 1' is shown in FIG. and that roll has different surface portions.

The conical portion 2' is provided for stretching the tubular billet 6, and merges in a transition zone or rolling shoulder 5, another portion of the roll establishes a smoothing surface zone 3' and immediately towards the end of the roll a rounding surface and zone 4' is provided.

FIG. 1 shows moreover an axis 1'' of the particular roll 1' to intersect at the point X, the axis 7' of rolling being identical with the axis of the rolling rod 7. In reality however these axes do not intersect so that in this regard the figure must be understood to constitute a projection of the axis 1'' of the roll into an axial plane for the axis 7' of the rod 7.

In the stretch zone a reduction occurs between the rod 7 on one hand and the surface of rolling on the other hand. The rolling gap reduces in the direction of rolling so that the wall of the hollow 6 is inevitably reduced to the prescribed tubular wall thickness. On the other hand, the circumference of the hollow billet widens in zone 4' in dependance upon the tension, speed and friction. At the end of the stretch zone a shoulder 5 becomes an element for determining the wall thickness of the tube and the smoothing zone 3'. This establishes the narrowest zone or area of the rolling gap.

The need for obtaining a smooth bore of the rolled hollow follows from the fact that there is a helical motion which the rolled stock undergoes, i.e. the rolled stock rotates and advances axially. If one considers moreover the particular section of the wall as it changes within the rolling gap and here particularly the stretch zone, it can readily be seen that a helical contour is rolled into the surface of the tube. One may consider this aspect in a somewhat simplified fashion.

F.ex. a particular local wall thickness section leaves the particular rolling gap from zone 5 and as defined by one of the three rolls at a particular point and after about 120 degrees rotation of the tube that particular portion enters the gap of the next roll. Since the rotation is accompanied by a axial advance, the front end of the particular portion in the wall considered will no longer be picked up by the stretch zone of this next roll. The particular portion in length direction that escapes the next roll has an axial length which is given by the longitudinal or axial advance of the rolled stock within a 120 degree turning angle. Therefore if the roll were provided only with a stretch zone one would obtain a saw-tooth like profile and section looping around the tubular configuration in a helical fashion. The wall thickness differences will of course be directly dependent upon the length of the section and the elevational or radial differences.

It follows from the foregoing that the smoothing portion of the roll, being so to speak, arranged downstream from the stretching zone has therefore the task of providing for a constant wall thickness of the tube. This is carried out in such a manner that the cooperation of the rolling rod 7 with the particularly contoured surface of the roll (3') results in a rolling gap which corresponds to the wall thickness of the tube being rolled and having a length in axial direction which is at least equal to the longitudinal advance of the rolled stock during a 120 degree of the rolled stock. In other words smoothing is obtained, in that for a particular length the distance between the surface of the roll, speaking generally but referring to zone 3' in particular, and the axis of rolling remains constant. The line of engagement between rolled stock and roll is therefore a three dimensional curve running on the cylindrical surface of a hypothetical cylinder. The diameter of that cylinder herein corresponds to the interior diameter of the interior tool, i.e. the rod 7, plus twice the wall thickness of the roll. It follows from the foregoing that the smoothing zone 3' of the roll as established, does not have in reality a straight line surface line, but as is also known from oblique roller type straightening machines for round stock that line is of a hyperboloid contour.

Figure 2:
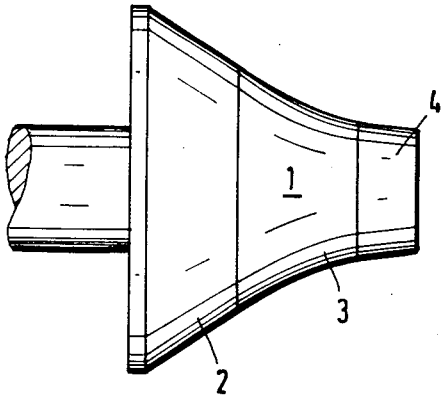
FIG. 2 illustrates a side elevation of a conical roll with a hyperboloid roll surface portion.

This particular aspect for such a roll 1 is shown in FIG. 2. That particular roll has again a stretch zone 2, a smoothing zone 3 and a rounding zone 4. There may be a transition or shoulder in between, which however has been omitted, because it is not essential for further detailing of the invention.

For the manufacture of different wall thicknesses therefore one obtains, as already mentioned, different axis diameters for the completed rolled tube, in that thick wall tubes will be widened very little if at all, thin wall tubes however will widen significantly in the rounding zone 4. In case there is a rather large range to be covered as between minimum and maximum wall thickness for different type hollow stock one obtains diameter differences in order of magnitude which in fact renders the utilization of such tubular billets in a subsequent stretch or size reducing mill uneconomical, because one simply had to use a large number of different kinds and types of sizing rolls. The argument in favor of high reduction oblique rolling mills is therefore rebutted for that particular reason. For this reason then, and particularly for economic reasons it is not economical for each tubular stock and wall thickness to have available in a high reduction rolling mill one particular and specialized mandrel rod diameter. Therefore the need arises to adjust the disposition and orientation of the rolls in the stand. This mode of operation makes sense for partical operation, becomes however unrealizeable for reasons of the particular adjusting facilities which are actually provided in a roll stand.

PRIOR ART DESCRIPTION

Theoretical investigations of the relations and conditions in an oblique rolling mill of the planetary type have demonstrated that the available adjusting system simply does not permit to cover with a single type of rolls an adequate diameter range in the sense of minimum and maximum diameter values. There is simply missing a mode of adjustment by means of which the rolls can be adjusted such that the aforementioned helically contoured wall thickness variations can be surpressed. For reasons of the constructive pecularities of a planetary type oblique axis rolling mill, it is simply not possible to provide for the requisite adjustment.

As can be seen from a German printed patent application 27 48 770, planetary type oblique rolling mills for the high reduction permits two adjusting possibilities. In one instance the head of the roll is pivoted about the axis of the planet wheel shaft, the other adjustment concerns the positioning of the roll itself in longitudinal direction of the rolling axes.

The German printed patent application 30 44 672 illustrates another mode of adjustment which however is in principle the same as far as effect as disclosed in the application 27 48 770 is concerned. There is however the difference that all rolls are adjusted simultaneously.

Another system is disclosed in German printed patent application 31 12 781 but this patent merely illustrates anotheer variation without change in principle.

In the case of a planetary type oblique axes rolling mill or any of the known variety it is inevitable that the conical pinion sitting on the planetary wheel shaft and the conical wheel which sits on the axis of the roll and meshes with the first mentioned pinion must remain very accurately, in a geometric sense, in mutual engagement. Since this is an indispensable requirement as particularly discernible from German printed patent application 27 48 770 one has available in fact only two degrees of freedom for establishing generally an adjusting system for the rolls.

In order to adjust a hyperboloid roll, particularly a hyperboloid smoothing surface of a roll within a three roll system, for accomodating different diameters of the rolled stock such that the spacially curved line of engagement between roll and tube has over the entire length uniform diameter from the center of the rolled stock, it is necessary to have a third degree of freedom. In a somewhat simplified fashion and for the hyperboloid roll in an oblique roller, straightening machine one can imagine that for a change in the diameter of the tube the roller is pivoted about an axis which has a right angle to the tube axis as well as to the longitudinal axis of the rollers and engages both of them.

Figure 3:
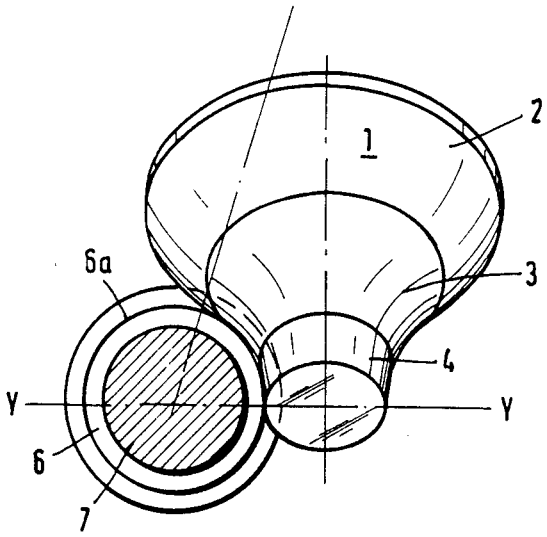
FIG. 3 illustrates the conical roll of the type shownn in FIG. 2 in a planetary type oblique axis rolling mill.

Analogously, FIG. 3 illustrates the, basically, conical roll one of a planetary oblique rolling mill, whose hyperboloidal smoothing zone 3 is situated at the rolling gap by engaging the outer diameter of the tube 6*a*. Now assume that this roll has to be pivoted about the axis Y—Y, simply because the diameter of the tube to be rolled is to be changed and the roll disposition has to be changed accordingly; the tube being arranged on the rolling rod 7. This particular mode of pivoting is simply missing in a planetary oblique rolling mill. This means that the rolls themselves have to be matched to the different tube diameter in order to roll a tube without the helical wall thickening as described. This however is in practice not possible, because one would need a plurality of differently contoured and dimentioned rolls in order to accomodate each situtation. As stated the third degree of freedom of adjustment is missing. Aside from the rather expensive inventory as far as different rolls are concerned, the exchange of rolls is always a cumbersome procedure and of course constitutes down time for the equipment and mill. Unsolved, however, is in any instance the problem of providing some fine correction of the roll disposition if f.ex. the roll as made does not match exactly the desired contour or if it begins to wear and has to be adjusted in order to compensate for this wear. In these particular cases it is simply undesirable to have a system which does not permit the third degree of freedom for purposes of adjustment.

DESCRIPTION OF THE INVENTION

It is an object of the present invention to extend the useability of conical rolls in correspondence with practical demands without however encountering conditions for smoothing operation which would interfere with tolerances concerning uniform wall thickness of the rolls and involving particularly any helicaly contour variation on the inside or the outside of both of the stock being rolled.

In accordance with the preferred embodiment of the present invention, it is suggested to mount each roll in a roll mount being pivotable about an axis that runs parallel to the axis of the stock to be rolled. The distance of that axis to the axis of the stock to be rolled will be changed either under maintaining parallelism with the rolling axis or by attainining a predetermined oblique disposition to thereby adjust the angular orientation of the roll vis-a-vis the periphery of the stock to be rolled.

The first step for attaining the object of the invention and realizing the proposed aspects thereof is the utilization of a planetary type rolling mill with oblique conical rolls but without a rotating frame, and to be used within a stationary roll stand and having three conical surface type rolls. This of course obviates the need for a planetary drive and, therefore, any dependance of the position of the rolls from very accurately defined meshing engagement between conical pinions and wheels within a planetary system. A regular three roll mill with conical obliquely oriented rolls differs from a three roll planetary rolling mill with obliquely oriented rolls by the stationary roll stand for similar or comparable disposition of the rolls and contour of the rolls. The planetary oblique roll mill is disadvantaged over the three roll mill with obliquely oriented conically contoured rolls byy aspects which are not immediately related to the invention, they should however be mentioned in order to gain a better understanding of the overall relations involved, and because the repective advantages are maintained even though planetation is avoided.

A planetary rolling mill with oblique rolls is basically comprised of a very heavy piece of equipment having a very large mass and which is caused to rotate about the hollow being rolled. By way of example for rolling a hollow billet having a maximum diameter of 9 5/8", the mass (of the mill) required to rotate is between 100–150 metric tons. The centrifugal force is substantial which means that the speed of rotation has to be limited severely. This of course limits the rolling speed of the product as it emerges from the stand. A comparable three roll mill with oblique oriented and conically contoured rolls does not have this limitation and therefore may have a three times higher rolling speed and throughput accordingly.

Another aspect to be considered is that in the case of a planetary type rolling mill, only relatively small tube diameters can be processed because the weight of the rotor with higher tube diameter becomes just too high. If one were to roll a 14" tube the weight of the rotating parts would be 300 and 400 metric tons. At this point the technical expenditure is no longer justifieable, and one must also consider that a considerable safety factor is involved here, i.e. the risk is very great if f.ex. in a relatively high speed operation the kinetic energy stored in the rotating mass, is so large, that in case of failure the kinetic energy that is released can cause extremely high damage.

The length of the tube to be made on a planetary type rolling mill is about 100 meters and possibly more, but is based on theoretical considerations. In practice the length of the tubing is more limited through the maximum passable raw weight of billets to be processed. An additional limitation is the capacity of the heating furnace in conjunction with the maximum number of tubes per hour. Even though planetary type mills on the average permit processing of larger tube lengths as a three roll conical mill with stationary rolling frame, the latter is faster in terms of exit speed of the rolled stock, as mentioned above, so that the total productivity expressed f.ex. in tons tubing per year is simply higher.

DESCRIPTION OF THE DRAWINGS (INVENTION)

Figure 4:
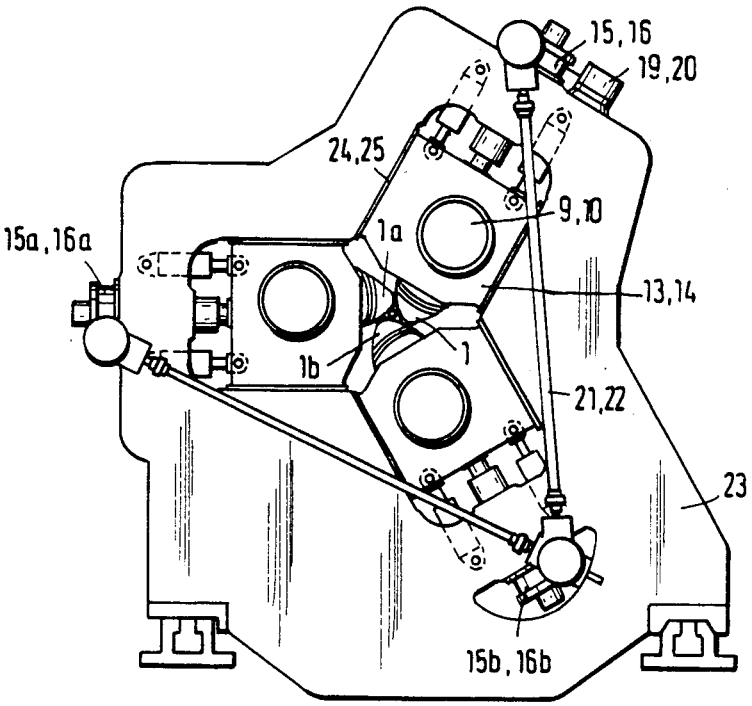
FIG. 4 illustrates a rolling stand as seen in the direction of rolling, including adjusting facilities.
Figure 5:
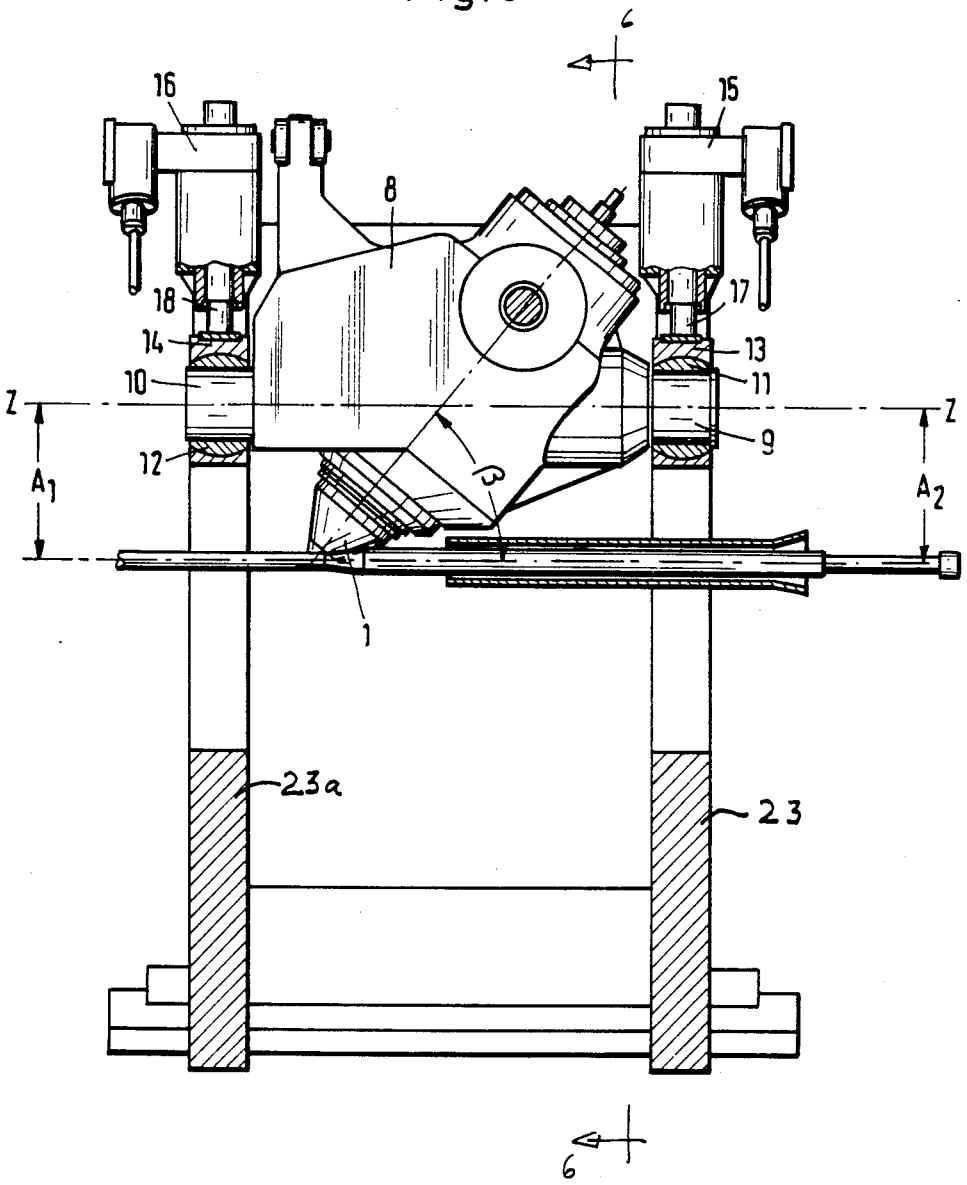
FIG. 5 illustrates a side elevation and partial section view of the device shown in FIG. 4.
Figure 6:
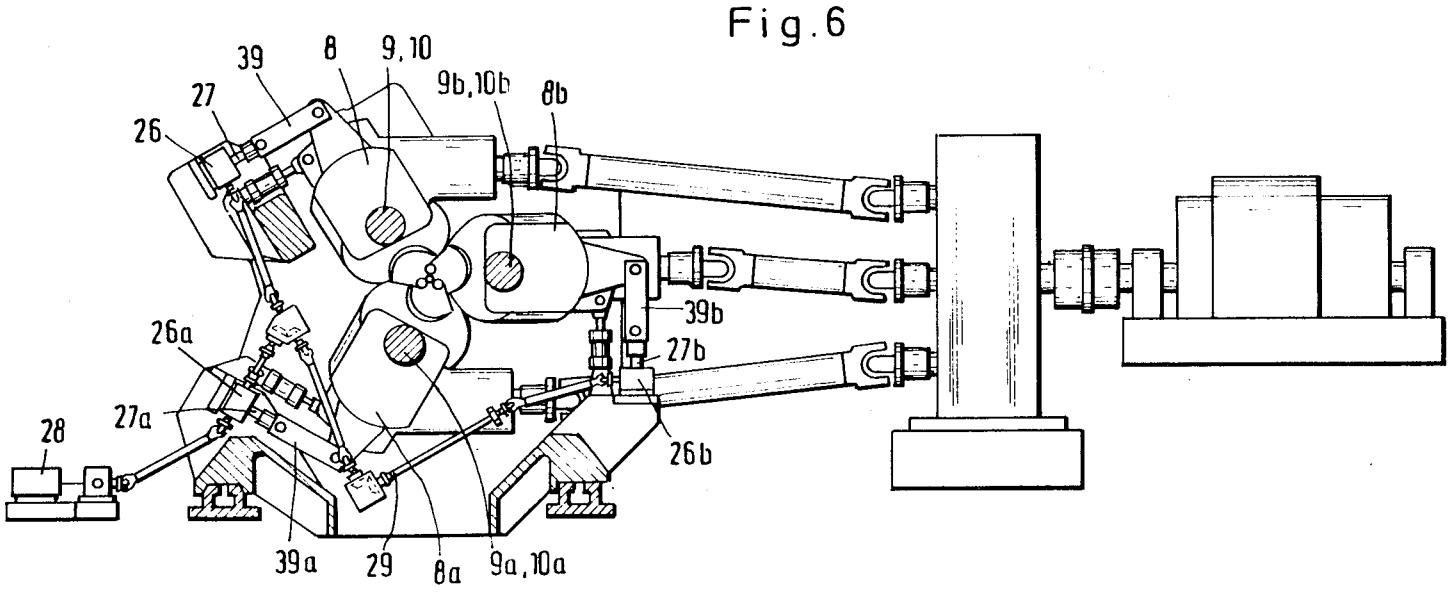
FIG. 6 illustrates a section through lines 6—6 in FIG. 5; p

Proceeding now to the description of drawings specifically directed to the invention, we refer to FIGS. 4, 5, and 6. Herein is depicted particularly a rolling mill with three obliquely oriented and conically contoured rolls, having an adjusting system for each of the three rolls, providing for an ajdustment of rolling in three degrees of freedom. Certain aspects of this arrangement have been described by me and others in U.S. patent application Ser. No. 597,685, filed Apr. 6, 1984.

FIG. 4 illustrates particularly a view as seen in the direction of rolling, showing a plate 23, which is part of the rolling frame and stand, there being three rolls 1, 1*a*, and 1*b*. The rolls 1, 1*a*, and 1*b* are mounted in roll mounts such as roll mount 8 in FIG. 5 for the roll 1, FIG. 6 shows analogeoulsy the roll mounts 8*a* and 8*b* respectively for rolls 1*a* and 1*b*. FIG. 5 shows a companion frame part 23*a*.

The roll mount 8 for the roll 1 is particularly illustrated in FIG. 5. This roll mount 8 has a front journal pin 9 which is mounted in a mounting and adjusting element 13, while the rear journal pin 10 of roll mount 8 is analogeously mounted in an element 14. These elements 13 and 14 are respectively mounted in the frame parts 23 and 23*a* respectively. The elements 13 and 14 slide in windows, such as a front window 24 and a rear window 25 in the frame elements 23 and 23' respectively. In accordance with FIG. 5 elements 13 and 14 are adjusted in a direction towards and away from the rolling axis by means of a drive 15 and 16, as well as spindels 17 and 18. This adjustinng system is designed so that the adjusting spindels 17 and 18 either run along equal paths which is the condition in which space A1 equals space A2 and the spreading angle beta for the rolls vis-a-vis the rolling axis remains invariant. (Freedom degree 1). If the spindels are adjusted to provide for unequal adjustments then the distance A1 will be different from the distance A2 and the angle beta is varied accordingly. This constitutes degree of freedom 2.

Since in accordance with FIG. 4 the frontal drives 15, 15*a*, and 15*b* for element 13 etc. are mechanically interconnected through linkeage 21 and since the rear drives 16, 16*a* and 16*b* for the elements 14 etc. are interconnected by the linkeage 22, it is clear that all three rolls 1*a* and 1*b* are synchronuously and symmetrically adjusted by operation of the adjusting motors 19 and 20 and to exactly the same degree. Details of this adjustment are shown also in the above mentioned application FIG. 3.

The adjustment of the third degree of freedom is illustrated in FIG. 6. This figure shows the rolling stand against the direction of rolling but without the front part 23 of the rolling stand (see lines 6—6 in FIG. 5). As already mentioned above the three roll mounts 8, 8*a*, and 8*b* have respectively coaxial pivot pins 9, 10; 9*a*, 10; and 9*b*, 10*b*; the roll mounts 8, 8*a* and 8*b* are now pivoted by means of adjusting drives 26, 26*a*, and 26*b* respectively under utilization of spindles 27, 27*a* and 27*b* respectively. Pivoting is carried out for roll 1 about the axis 2—2 as defined by journal pins 9 and 10. The adjusting drives 26, 26*a* and 26*b* are all driven by the motor 28 and are interconnected through linkeage and the articulate linkeage arrangement 29. The adjustment provided by these elements is also disclosed in the above identified application but not claimed.

In order to compensate for the spacial pivot motion of the roll mounts 8, 8*a* and 8*b* one can see that the pivot pins 9 and 10, f.ex. for the pivot mount 8, are provided with ball sleeves 11 and 12 to permit rotational adjustment of the journal pins 10 and 9, vis-a-vis the elements 13 and 14. Moreover as shown in FIG. 6 the adjusting spindles 27, 27*a* and 27*b* are respectively provided with connecting pieces 39, 39*a* and 39*b*, so as to permit the requisite adjusting motion.

Figure 7:
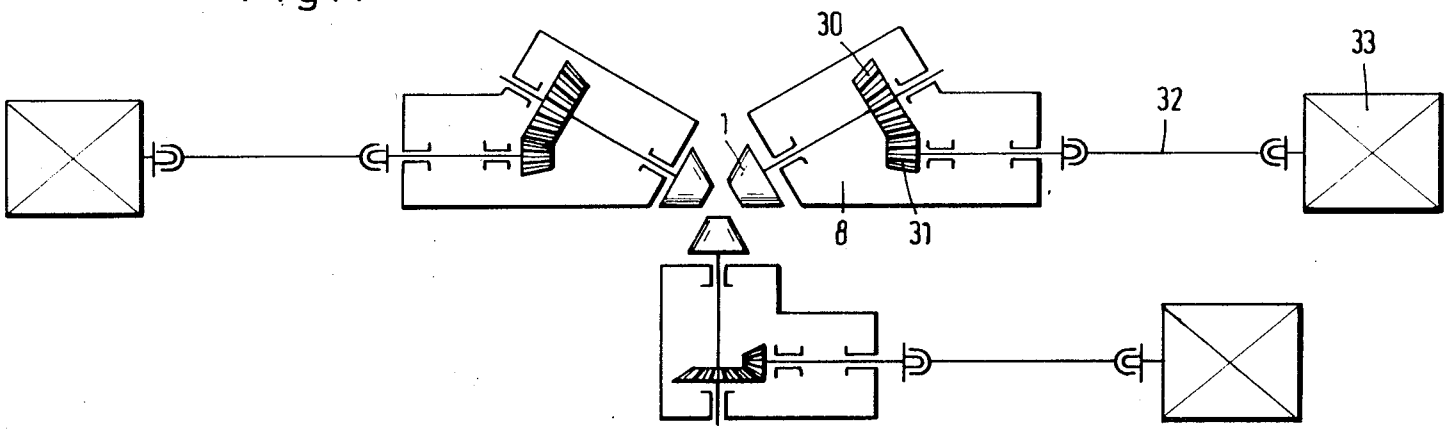
FIG. 7 illustrates somewhat schematically the arrangement of axes and drive mechanisms for practicing the preferred embodiment of the present invention in accordance with a best mode configuration.

The drives of the rolls themselves are shown in FIG. 7; this drive system is configured so that the pivot motions of the roll mounts 8, 8*a*, 8*b* are not transferred upon the drives. In the case of roll 1 having the mount 8 one can particularly see that the drive axis for roll 1 is provided to be coupled to a shaft 32 having a horizontal disposition. A pair of conical gears 30 and 31 connect the shaft for roll 1 to the articulated shaft 32. The articulation will compensate the pivot motion, so that indeed the drive motor 33 can be stationarily mounted. The situation is analogous for the other rolls and their mounts.

Figure 8:
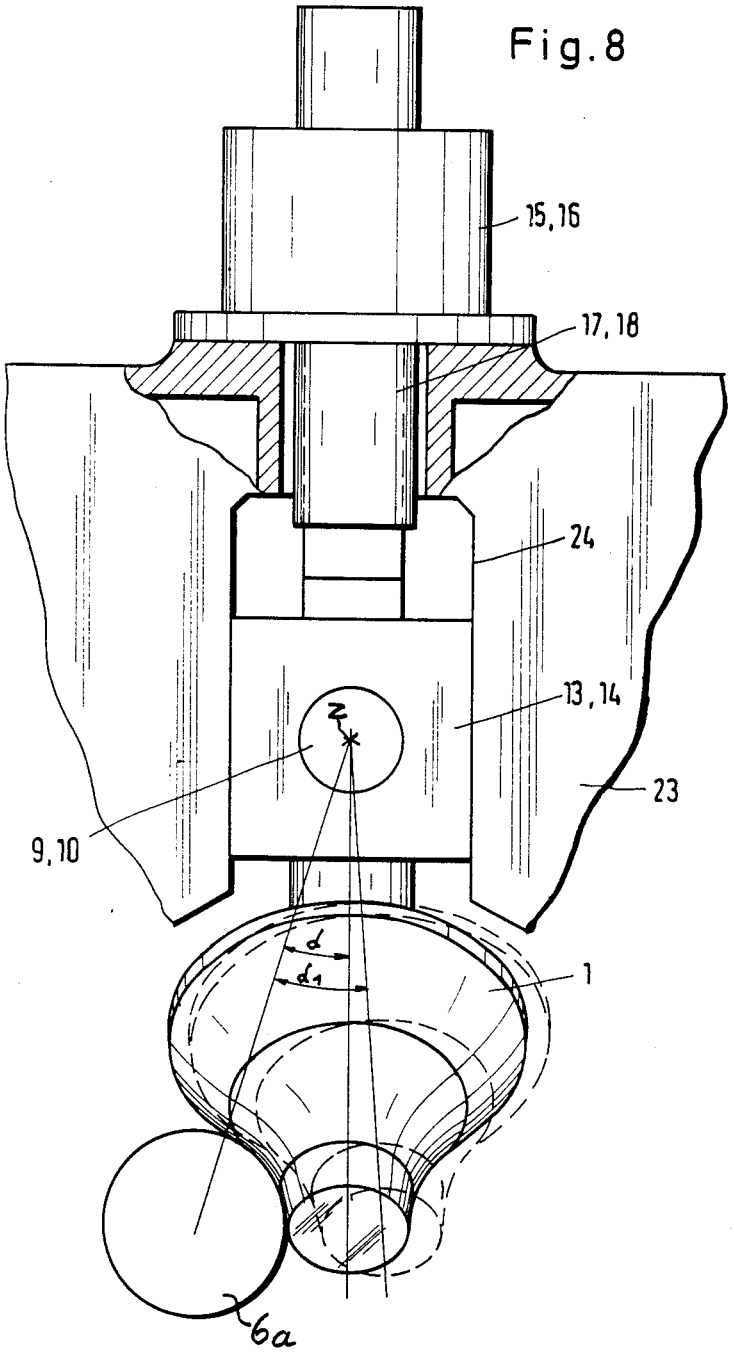
FIG. 8 illustrates a detail of rolling stand position with conical-hyperbolic rolls; p

As was mentioned above the slide and mount elements 8 etc. for mounting the rolls slide in windows 24 etc. of the roll stand parts 23 and 23*a*. FIG. 8 illustrates in particular a portion of the mill frame 23 as well as the window 24, therein showing also the front and the rear slide element 13 and 14, respectively with frontal and rear pivot pins 9 and 10. Also shown are the drives 15 and 16 with the adjusting spindles 17 and 18 respectively as well as the roll 1. The roll 1 with mount will be pivoted about the axis Z—Z as shown in FIG. 5, in dependence upon the diameter of the tubular hollow to be rolled. This pivoting amounts particularly to an adjustment of the angle alpha in FIG. 8 to assume the value alpha 1. A mathematically exact abuttment of the smoothing zone 3 of the roll 1 against the periphery 6*a* of the hollow, also in accordance with FIG. 3, will be attained only if as shown in FIG. 5, the spreading angle beta can be changed without changing the distances A1 and A2 of the pivot axes Z—Z from the longitudinal axis of rolling. This is no contradiction to the previously made requirement that for obtaining the second degree of freedom of roll adjustment one must maintain the condition $A_1$ does not equal $A_2$. This condition is primarily fullfilled through the requirement of changing the spreading angle beta. The unequal changes of the distances $A_1$ and $A_2$ as per FIG. 5 is only a result of the constructive features for adjusting of the rolls.

Figure 9:
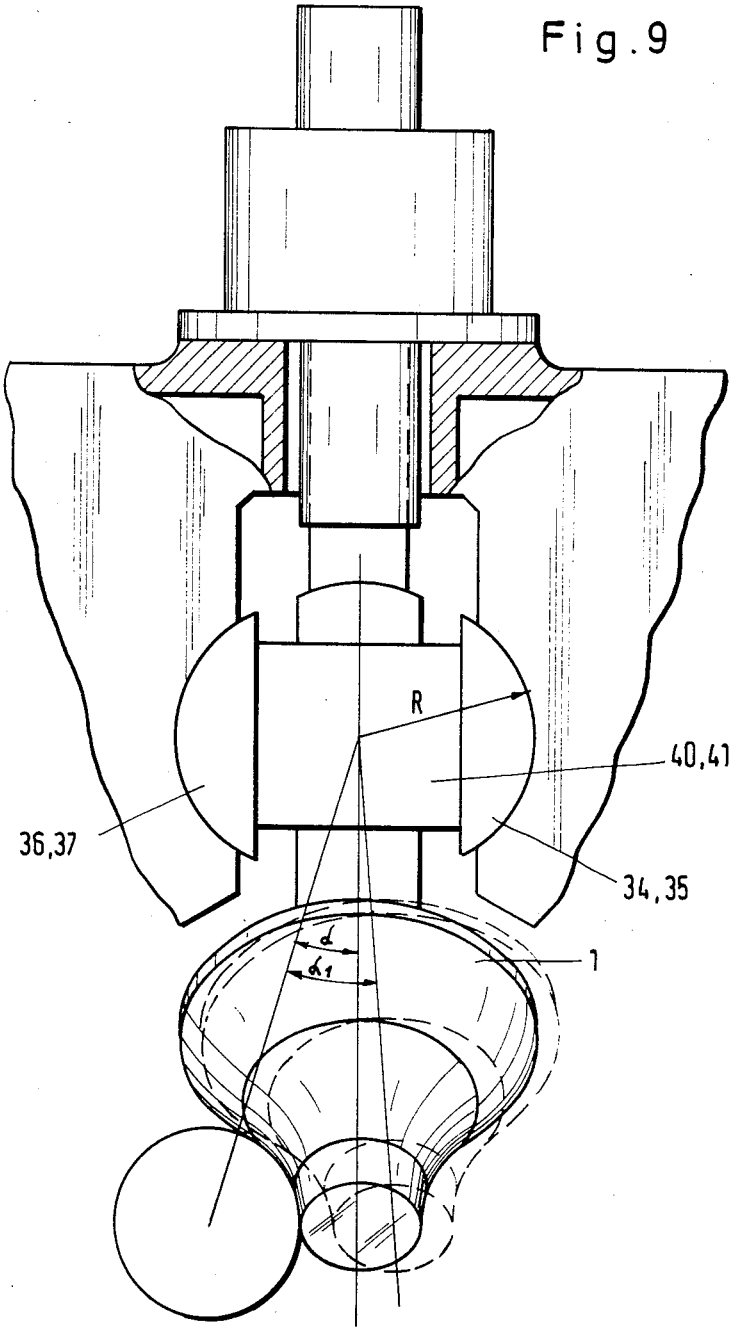
FIG. 9 is similar to FIG. 8, but showing also a modification.
Figure 10:
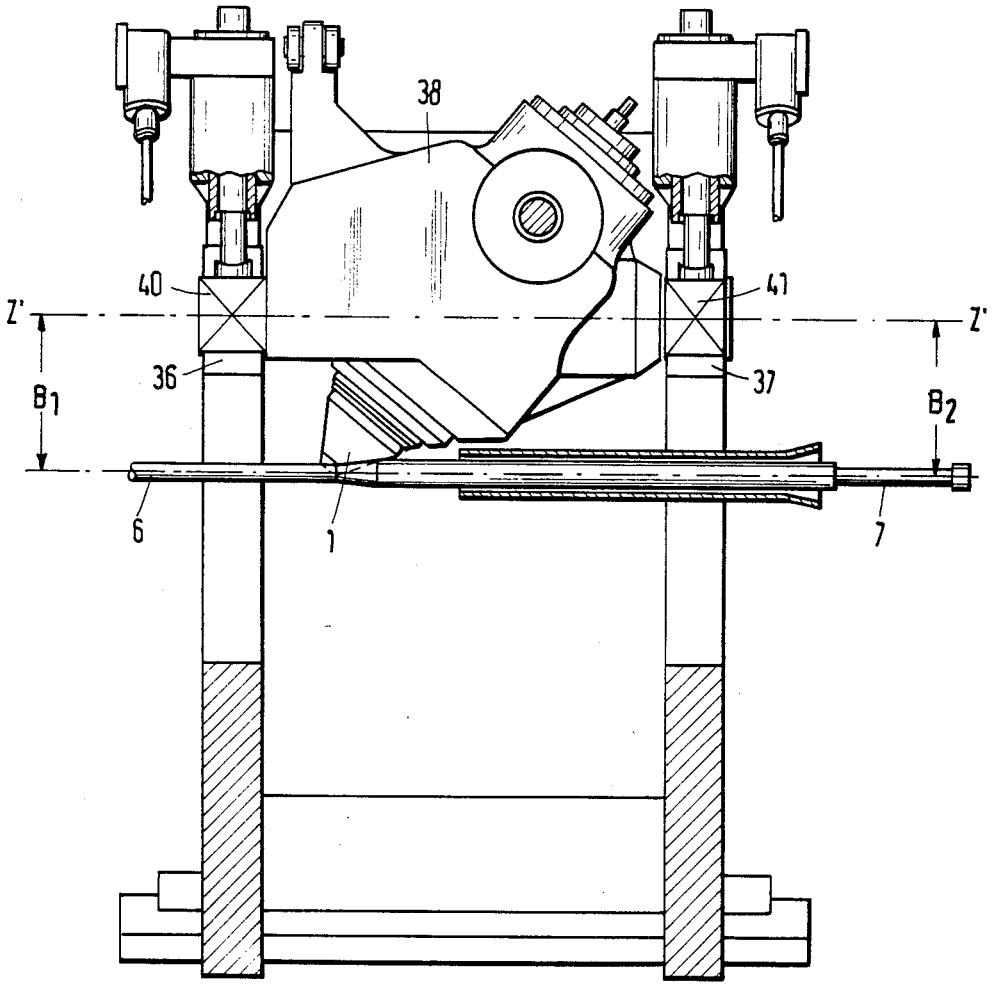
FIG. 10 illustrates an arrangement similar to FIG. 5.

A mathematically more exact adjustment is shown in FIG. 9 and 10. Herein is illustrated a roll mount 38, visibly only in FIG. 10, with its two ends 40 and 41. The two ends 40 and 41 of the roll mount 38, as well as the roll 1 itself are positioned in two frontal pivot pieces 34 and 36 two rear pivot pieces 35 and 37. The pivot axis Z′ Z′ remains in a constant position inspite of the adjustment of the roll mount 38, i.e. the spaces B1 and B2 as shown in FIG. 10 and denoting the spacing of the pivot axis Z′—Z′ from the axis of rolling remains invariant even though the spreading angle 8 is changed. Therefore the axis Z′ Z′ and the axis of rolling and being the longitudinal axis of the hollow stock, remain in parallel to each other.

Now it is possible to satisfy and maintain the condition that each point of the spacial i.e. three dimensional line of engagement or contact of the roll 1 and here particularly of the smoothing zone 3, as shown in FIG. 3, with the rolled hollow will have always the same distance from the cylindrical surface of the hollow or tube 6*a* within the rolling gap, which of course is the same thing as saying that this particular line of engagement has always the same distance from the axis of the rolled stock.

Since for each diameter change of the hollow to be rolled three degrees of freedom of the roll adjusting system have to be adjusted normally and in particular relation to each other, in order to eliminate and avoid the formation of helical thickening of the hollow to be rolled, each of the three adjusting possibilities require adjustment by an exactly and precisely defined path and/or angle.

In accordance with the invention it is therefore appropriate to couple the adjusting system with a programmable computer which calculates the various parameters by means of which the several drives and particularly the adjusting drives are controlled. This computer in turn may operate in feed back configuration with a contactless device for measuring wall thickness. Such a measuring device will ascertain the profile of any helical wall thickening or any deviation of the wall thickness from a standard or reference value. This deviation will then be inputted to the computer, which calculates the requisite signals for obtaining the desired and requisite adjustment for correcting the orientation of the rolls.

The invention is not limited to the embodiments described above but all changes and modifications thereof, not consituting departures from the spirit and scope of the invention, are intended to be inclined.

We claim:

1. Rolling mill with three obliquely positioned rolls having an overall conical contour of rolling and being arranged symmetrically in relation to a center, said rolls being off set in relation to each other by 120 degrees and have an oblique disposition in relation to the axis of rolling of a particular spreading angle, there being a roll stand; a mounting and adjusting arrangement comprising;

each roll being mounted in a roll mount for pivoting about an axis normally running parallel to the axis of the stock being rolled; and means for varying the distance of said pivot axis in relation to said axis of rolling under maintaining of parallelism or under tilting in order to obtain a reorientation of the rolls vis-a-vis the periphery of rolled stock in engagement with rolls.

2. In a rolling mill as in claim 1, wherein said adjusting devices for all rolls are interconnected.

* * * * *